US008308397B2

(12) United States Patent
Danskine

(10) Patent No.: US 8,308,397 B2
(45) Date of Patent: Nov. 13, 2012

(54) CONCRETE FLOAT AND METHOD OF MANUFACTURE

(76) Inventor: Allen J. Danskine, Bow, WA (US)

( * ) Notice: Subject to any disclaimer, the term of this patent is extended or adjusted under 35 U.S.C. 154(b) by 244 days.

(21) Appl. No.: 12/618,144

(22) Filed: Nov. 13, 2009

(65) Prior Publication Data

US 2010/0124461 A1 May 20, 2010

Related U.S. Application Data

(60) Provisional application No. 61/199,265, filed on Nov. 14, 2008.

(51) Int. Cl.
*B63B 35/44* (2006.01)

(52) U.S. Cl. ..... 405/219; 405/220; 114/264; 114/266; 114/267

(58) Field of Classification Search ..... 405/218, 405/219, 220, 221; 114/263, 264, 266, 267
See application file for complete search history.

(56) References Cited

U.S. PATENT DOCUMENTS 3,073,274 A * 1/1963 Lamb ..... 405/219
3,448,709 A * 6/1969 Hardwick, Jr. ..... 114/266
3,779,192 A * 12/1973 Gonzalez ..... 114/266
3,913,336 A * 10/1975 Figari ..... 405/222
3,977,344 A * 8/1976 Holford ..... 114/263
4,318,361 A * 3/1982 Sluys ..... 405/219
4,318,362 A 3/1982 Jung
4,342,276 A * 8/1982 Sluys ..... 405/219
4,709,647 A * 12/1987 Rytand ..... 405/219
4,715,307 A 12/1987 Thompson
4,803,943 A * 2/1989 Corbett ..... 405/219
4,940,021 A * 7/1990 Rytand ..... 405/219
4,947,780 A * 8/1990 Finn ..... 114/263
4,953,280 A 9/1990 Kitzmiller
4,962,716 A * 10/1990 Fransen et al. ..... 405/219
5,044,296 A * 9/1991 Finn ..... 114/263
5,347,948 A * 9/1994 Rytand ..... 405/219
5,404,825 A * 4/1995 McElwain ..... 114/263
5,529,012 A 6/1996 Rytand
5,713,296 A * 2/1998 Gervasi et al. ..... 114/266
5,911,542 A * 6/1999 Obrock et al. ..... 405/219
5,950,558 A 9/1999 Strong
6,427,395 B1 * 8/2002 Elsasser et al. ..... 405/218
6,450,737 B1 9/2002 Rytand et al.
7,390,141 B2 6/2008 Rytand

* cited by examiner

*Primary Examiner* — Frederick L Lagman
(74) *Attorney, Agent, or Firm* — Klarquist Sparkman, LLP

(57) ABSTRACT

A concrete floating dock can be formed using a form that has an inner and an outer form. Concrete sections can be cast such that they include a deck portion and two longitudinally extending side walls that extend downwardly from the deck portion. The concrete sections can be removed from the form and coupled together to form a concrete floating dock. One or more buoyancy elements can be positioned in the cavities of the fully cured concrete sections before or after the concrete sections are coupled to each other.

13 Claims, 9 Drawing Sheets

CONCRETE FLOAT AND METHOD OF MANUFACTURE

CROSS REFERENCE TO RELATED APPLICATION

This application claims the benefit of U.S. Provisional Application No. 61/199,265, filed on Nov. 14, 2008. The entire disclosure of U.S. Provisional Application No. 61/199,265 is considered to be part of the disclosure of the following application and is hereby incorporated by reference.

FIELD

This application relates generally to concrete floating docks and, more specifically, to concrete floating docks that can be formed from sections that can be transported to a jobsite in a disassembled state.

BACKGROUND

Floating dock structures are widely used in marinas and boat harbors as a means for mooring watercraft and as wave-attenuation devices. Typically, floating dock structures are constructed by interconnecting individual or modular float sections. Historically, concrete float units were cast as six-sided modules, with integral bottoms. These modules, which were usually about 8' to 12' long, were structurally interconnected using timber or steel members, called wales. Today, however, concrete floats are traditionally constructed as five-sided, monolithic structures that do not require the use of longitudinal structural members, such as disclosed in U.S. Pat. No. 6,450,737, the entire disclosure of which is incorporated herein by reference.

Regardless of whether a concrete float is constructed as a modular unit or a monolithic structure, a positive displacement element, such as expanded polystyrene foam (EPS), is typically positioned within an outer form and concrete is poured over and/or around the positive displacement element. Before the advent of EPS in block form, the inner form typically comprised a wax-treated, reinforced cardboard box member. Thus, the positive displacement element (and, previously, the cardboard box member) provides the internal form for forming the concrete structure and, after the concrete cures, is integrated into the structure of the concrete float.

SUMMARY

In one embodiment, a method of forming a concrete floating dock is provided. The method includes providing at least one mold having at least an inner form and an outer form; casting a plurality of concrete sections in the at least one mold, the concrete sections having a deck portion and two longitudinally extending side walls that extend from one side of the deck portion; removing the concrete sections from the at least one mold; and coupling the plurality of concrete sections to one another to form a concrete floating dock. In specific implementations, the method further comprises, after removing the concrete sections from the mold, positioning a buoyancy member between longitudinally extending side walls of each concrete section. In other specific implementations, the method further comprises securing the buoyancy member to each concrete section.

In other specific implementations, the act of casting the plurality of concrete sections comprises adding a plurality of conduit members to each concrete section. The conduit members form openings that extend within one or more of the deck portion and two longitudinally extending side walls of each concrete section. In other specific implementations, the act of coupling the plurality of concrete sections to one another comprises passing rods through the conduit members and securing the rods to a first end of the floating dock and to a second end of the floating dock.

In another embodiment, a floating dock assembly is provided. The assembly includes a plurality of concrete sections comprising a deck portion, two opposing longitudinally extending side walls, and two open sides adjacent to each of the side walls. The assembly further includes a plurality of connecting members that are configured to connect the concrete sections to one another. In a specific implementation, the concrete sections further comprise a plurality of openings extending longitudinally through one or more of the deck portion and two side walls. The connecting members are configured to pass through corresponding openings in a plurality of concrete sections.

In another specific implementation, the connecting members are rods that pass through the openings of the plurality concrete sections and are secured at a first end of the plurality of concrete sections and at a second end of the plurality of concrete stations. In another specific implementation, at least some of the plurality of concrete sections are oriented at an angle to other concrete sections. In another specific implementation, a first concrete section is positioned perpendicularly to a second concrete section, and the first and second concrete sections are coupled by at least one hinge member.

In another embodiment, a method of assembling a concrete floating dock is provided. The method includes positioning a plurality of concrete sections adjacent to one another, coupling the plurality of concrete sections together to form a unitized float assembly, and positioning at least one buoyant member beneath the deck portion and between the pair of the side walls of the one or more of the concrete sections. Each concrete section comprises a deck portion, a pair of longitudinally extending side walls, and two opposing open faces between respective ends of the side walls, the concrete sections being positioned so that the open face of one concrete section abuts the open face of an adjacent concrete section.

In specific implementations, the method further comprises forming the at least one buoyant member by cutting a portion from a block of buoyant material. The buoyant member can be cut to fit between the pair of side walls of one or more concrete sections. The buoyant member can be positioned beneath the deck portion and the side walls of one or more of the concrete sections after the concrete sections are coupled to each other.

In other specific implementations, the act of positioning the at least one buoyant member comprises positioning the at least one buoyant member beneath the deck portion and pair of side walls of two or more of the concrete sections. In other specific implementations, the at least one buoyant member comprises a single buoyant member that extends between the pairs of the longitudinally extending side walls of each concrete section. In other specific implementations, the buoyant member comprises a plurality of buoyant members coupled together end-to-end by an adhesive.

In other specific implementations, the method can further comprise securing the at least one buoyant member to one or more of the longitudinal side walls. The act of securing the buoyant member can comprise securing inserting mechanical fasteners through one or more openings in one or more of the side walls of the concrete sections and into the buoyant member. The act of coupling the plurality of concrete sections to form the first unitized assembly can comprise passing rods through openings that extend longitudinally through the side walls of the concrete sections and securing the rods to a first end of the first unitized assembly and to a second end of the first unitized assembly.

In another specific implementation, the method can further comprise securing a first end panel against an open face of one of the concrete sections, the end panel forming a first end of the unitized assembly. In another specific implementation, the method can comprise securing a second end panel against an open face of another of the concrete sections, the second end panel forming a second end of the unitized assembly.

In another specific implementation, the method can further comprise coupling a plurality of concrete sections to one another to form another unitized float assembly. Each concrete section comprising a deck portion and a pair of longitudinally extending side walls. The method can also comprise positioning at least one buoyant member beneath the deck portion and between the pairs of the longitudinally extending side walls of the one or more of the concrete sections of the another unitized float assembly and coupling the unitized float assembly to the another unitized float assembly.

In another specific implementation, the unitized float assembly can be oriented substantially perpendicular to the another unitized float assembly. The coupling of the unitized float assembly to the another unitized float assembly can comprise securing a first portion of a hinge member to the unitized float assembly and securing a second end of the hinge member to the another unitized float assembly.

In another embodiment, a floating dock assembly is provided. The assembly can comprise a plurality of concrete sections each comprising a deck portion, and a pair of longitudinally extending side walls, and two opposing open sides adjacent to each of the side walls. The assembly can also comprise a plurality of connecting members coupling the concrete sections to one another to form a unitized float assembly, with the concrete sections being coupled so that the open face of one concrete section abuts the open face of an adjacent concrete section. The assembly can further comprise at least one buoyant member positioned beneath the deck portion and between the side walls of one or more concrete sections.

In a specific implementation, the assembly can further comprise a first end panel positioned adjacent to one of the open faces of the concrete sections, the first end panel forming a first end of the unitized float assembly. The assembly can further comprise a second end panel positioned adjacent to another one of the open faces of the concrete sections, the second end panel forming a second end of the unitized float assembly.

In another specific implementation, the at least one buoyant member can comprise a first buoyant member that extends between two or more pairs of side walls. The concrete sections can further comprise a plurality of openings extending longitudinally through one or more of the deck portions and the pairs of side walls, wherein the openings in adjacent concrete sections are substantially aligned and the connecting members pass through the aligned openings of the concrete sections.

In another specific implementation, the connecting members can be rods that pass through the openings of the plurality of concrete sections and are secured at a first end and a second end of the unitized float assembly. In another specific implementation, the side walls of adjacent concrete sections can be aligned end-to-end along the length of the unitized float assembly.

In another specific implementation, the unitized float assembly can comprise a first unitized float assembly. The assembly can further include a second unitized float assembly, the second unitized float assembly comprising a plurality of concrete sections each comprising a deck portion, and a pair of longitudinally extending side walls, and two open sides adjacent to each of the side walls. A plurality of connecting members can connect the concrete sections to one another to form the second unitized assembly. At least one buoyant member can be positioned beneath the deck portion and the side walls of one or more concrete sections of the second unitized float assembly. The second unitized float assembly can be oriented substantially perpendicular to the first unitized float assembly. In a specific implementation, the first unitized assembly can be coupled to the second unitized assembly by at least one hinge member.

The foregoing and other objects, features, and advantages of the disclosed embodiments will become more apparent from the following detailed description, which proceeds with reference to the accompanying figures.

DETAILED DESCRIPTION

As used in this application and in the claims, the singular forms "a," "an," and "the" include the plural forms unless the context clearly dictates otherwise. Additionally, the term "includes" means "comprises." Further, the terms "coupled" and "associated" generally means electrically, electromagnetically, and/or physically (e.g., mechanically or chemically) coupled or linked and does not exclude the presence of intermediate elements between the coupled or associated items.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

Figure 1A:
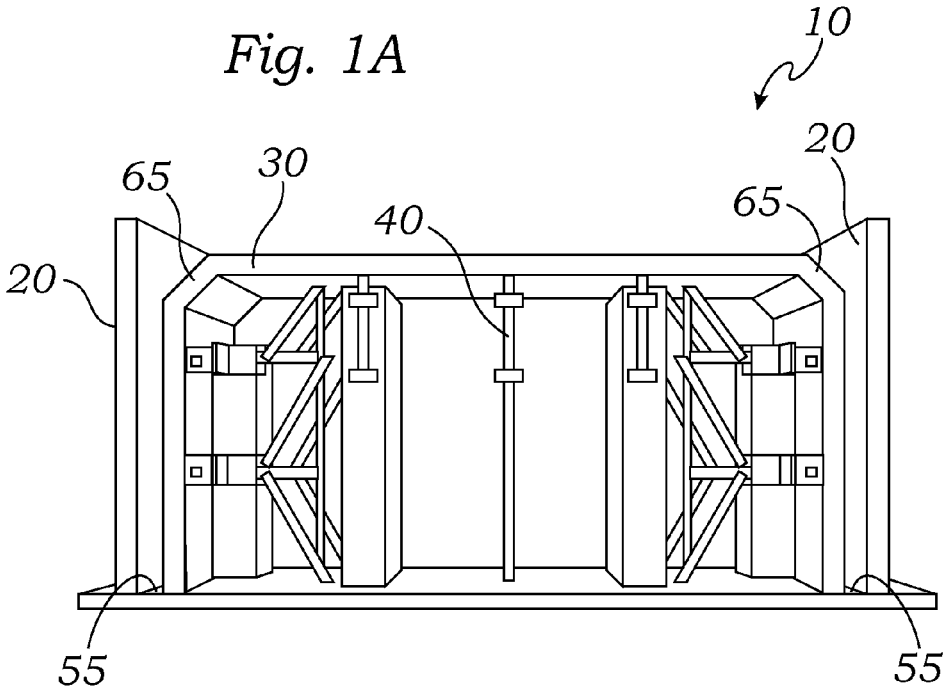
FIG. 1A shows a concrete form assembly according to one embodiment, that has an inner form and an outer form, with front and back end sections removed for clarity.
Figure 1B:
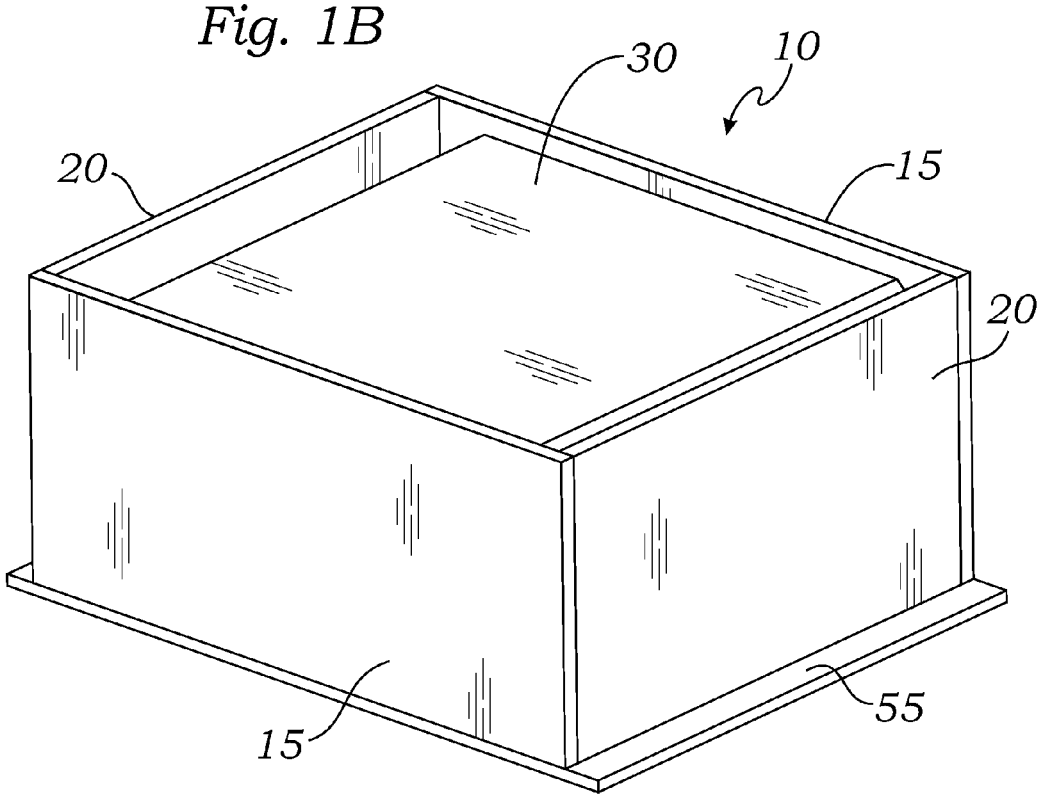
FIG. 1B shows a perspective view of the concrete form assembly of FIG. 1A.
Figure 2:
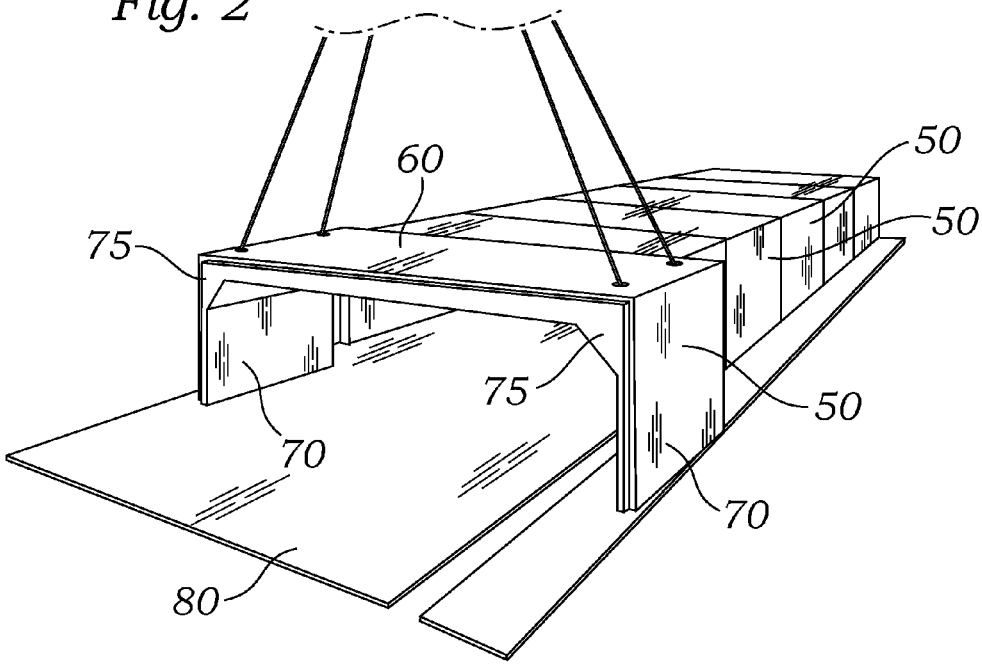
FIG. 2 is a perspective view showing a plurality of exemplary concrete sections positioned adjacent to one another.
Figure 3:
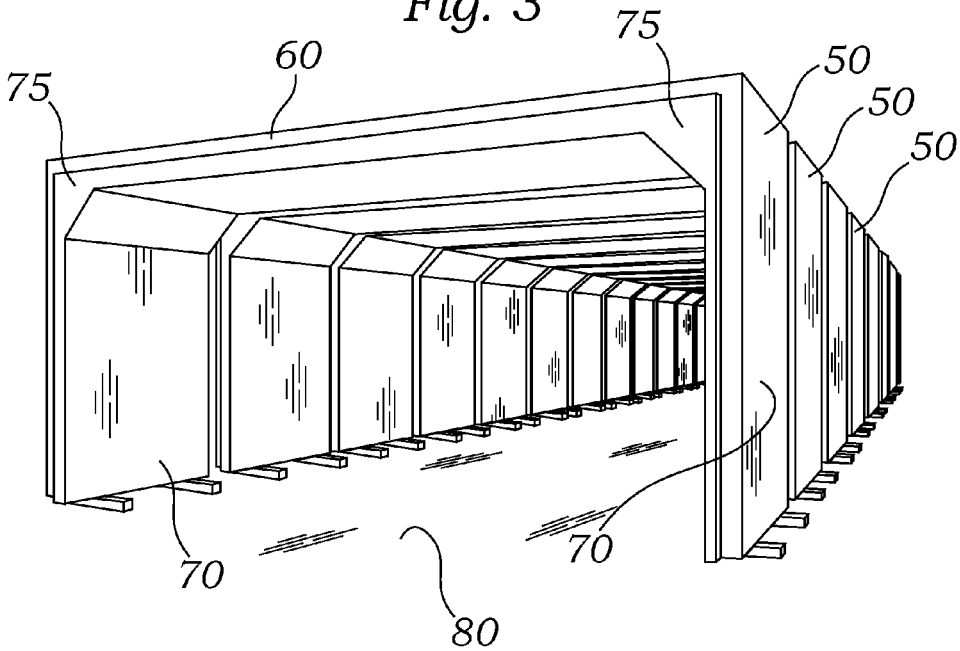
FIG. 3 is another perspective view showing a plurality of concrete sections positioned adjacent to one another.

FIG. 1A illustrates a form, or mold, 10 for forming concrete float sections 50 (FIG. 2). Referring to FIGS. 2 and 3, the form is shaped to form a three-sided concrete section 50, which resembles a box-bridge unit (upside-down "U") or a box-culvert unit (right side-up "U"). Form 10 includes outer elements 20 and an inner element 30. As shown in FIG. 1B, form 10 can also include end walls 15. End walls 15 and outer elements 20 collectively enclose the inner element 30 to provide the outer structure of the form 10 and to contain the concrete material as it is poured into the form 10.

As shown in FIGS. 2 and 3, concrete sections 50 can be formed with a deck portion 60, a pair of opposing longitudinal side walls 70, an open bottom, and two open opposing transverse sides that are adjacent to and extend between respective ends of the side walls 70. Steel reinforcing bars ("re-bars") can be embedded within the concrete section 50 for structural strength. The re-bars are desirably embedded in one or more of the deck portion 60 and side walls 70.

Referring again to FIG. 1, outer elements, or form sections, 20 determines the outer shape of the concrete section 50. Each outer element 20 is configured to form the shape of the outer surface of a respective side wall 70 (FIG. 2). Inner element 30 is configured to form the shape of the inner surfaces of the side walls 70 and the bottom surface of deck portion 60. A base portion 55 forms the lowest surface of the up-side down "U" shape of the concrete section 50 (e.g., the bottom surfaces of side walls 70). Base portion 55 can be a separate element or it can be configured to be part of outer element 20 or inner element 30. Although form 10 is configured to form the concrete section 50 in the upside-down "U" configuration, a form could be constructed so that the concrete section 50 would be formed in a right-side up "U" configuration, in which case the concrete section 50 would need to be inverted sometime before the actual construction of the concrete floating dock.

Inner element 30 also preferably has angled portions 65, which extend longitudinally at each side of the inner element 30. When concrete is poured into the form 10, angled portions 65 create correspondingly angled corner portions 75 in the cured concrete section 50. Corner portions 75 extend longitudinally at the corners between the deck portion 60 and the side walls 70. Corner portions 75 are formed integral with the deck portion 60 and side walls 70 and strengthen the structural integrity of the concrete sections 50.

Form 10 is desirably constructed of steel; however, if desired, other materials, such as wood, can be used to construct the form 10. Various bracing elements 40 can be positioned within the inner element 30 to increase the strength of the inner element 30. The amount of bracing required will vary depending on the size of the concrete section 50 and the thickness of the deck portion 60 and the longitudinal side walls 70. Other techniques and mechanisms can be used to form the concrete sections 50. One such alternative technique for forming three-sided (i.e., "U"-shaped) concrete sections is described in U.S. Pat. No. 4,953,280, the entirety of which is hereby incorporated by reference.

The float units can be cast in a variety of widths and lengths. Desirably, they are cast as widths ranging from about 4 feet to 35 feet (the width being measured from one side wall 70 to the other side wall 70), and lengths ranging from about 4 feet to 12 feet. These lengths and widths are desirable to provide the requisite structural integrity required to function as, when connected together, a monolithic concrete dock float. In addition, casting of the concrete sections 50 in the sizes described above facilitates truck shipment of the concrete sections 50. Units of the above-described sizes can be transported with the width oriented lengthwise on a truck bed or rail car for assembly at or near the jobsite. Thus, the transport of concrete floats with widths of up to about 35 feet can be relatively easily accomplished. In addition, by forming the concrete float in sections, concrete sections 50 can be standardized by width and depth, enabling stockpiling of units (without EPS foam cores) prior to the design of electrical and mechanical utilities for particular applications.

As noted above, traditional concrete float structures are formed with a positive displacement element integral with the concrete structure. By casting a concrete section 50 with a removable inner element or form rather than with a permanently affixed, positive displacement element forming an inner core, the concrete sections 50 can be formed more accurately. First, the inner element 30 described above is reusable. Thus, the same inner element 30 can be used as the inner form to construct multiple concrete sections 50, which increases the consistency and accuracy of the shape and size of each concrete section. In contrast, when using an EPS foam core (i.e., the positive displacement element method) a new EPS foam element is required for each concrete section and for each casting cycle. Typically, the EPS foam elements must be manually cut or formed to the desired shape and size for the particular application, and therefore, it is difficult to maintain dimensional consistency between each float. Using a different EPS foam element as the inner core of each concrete section therefore can result in concrete floats that vary in size and weight, depending on the dimensional accuracy of each EPS foam element.

Using an inner element 30 made from steel (or other similar materials) also provides greater accuracy in casting units of identical weight than is possible using EPS foam as the positive displacement element. Steel (and other similar materials) can be constructed with high dimensional accuracy. The dimensional accuracy of EPS foam, however, can vary depending on the methods of construction and/or the methods of cutting the EPS foam to size. Thus, depending upon the dimensional tolerances of the manually-fabricated foam cores, the use of EPS foam as an inner core can result in heavier or lighter floats.

In addition, even if the dimensional accuracy of the EPS foam is high, it can be difficult to maintain the proper position of the EPS foam while casting the concrete. If the EPS foam moves out of position, even slightly, during casting, the concrete sections can be formed with inconsistencies that can result in an un-balanced dock and/or induce additional stresses on the floating dock system when the system is put into its intended use.

Curing times can also be reduced by using the inner element 30 described herein. By forming concrete sections 50 with an inner element 30, the units may be heat cured from inside and the outside, rather than just outside-in as is the case with EPS foam core forming methods (i.e., positive displacement element forming methods). The reduction of curing times increases the throughput for each form and permits multiple cycles to be cast per day using a single form.

After the concrete sections 50 are cured, they can be brought together to be unitized into their ultimate length or increments thereof, preferably, although not necessarily, after the individual sections 50 are transported to an assembly location at or near the jobsite. Two or more concrete sections 50 can be positioned end-to-end using a crane or other lifting mechanism, as shown in FIG. 2. Desirably, the two or more concrete sections 50 are unitized on a level surface or bed 80. As used herein, the term "unitized" means coupling two or more separate structures together in a manner that substantially resists relative movement between the two or more structures. For example, a unitized float assembly comprises two or more concrete float sections that are coupled to each other in a manner to substantially resist any relative movement between the float sections.

Figure 4:
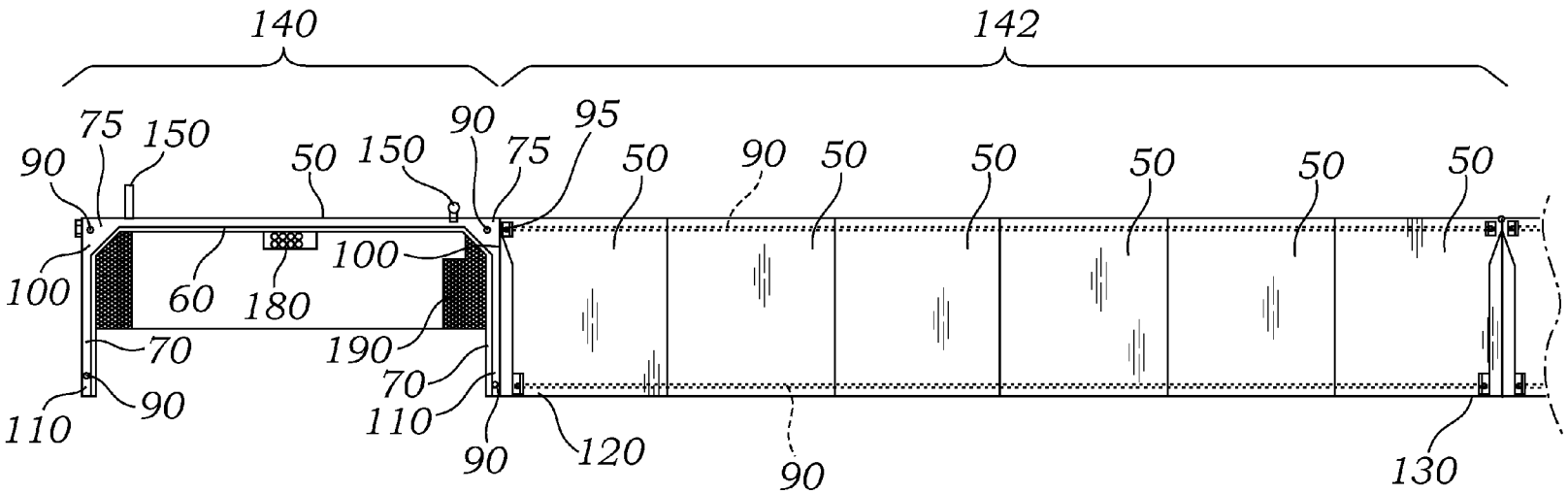
FIG. 4 is an elevation view of a concrete float assembly having at a plurality of concrete sections coupled together, according to one embodiment.
Figure 5:
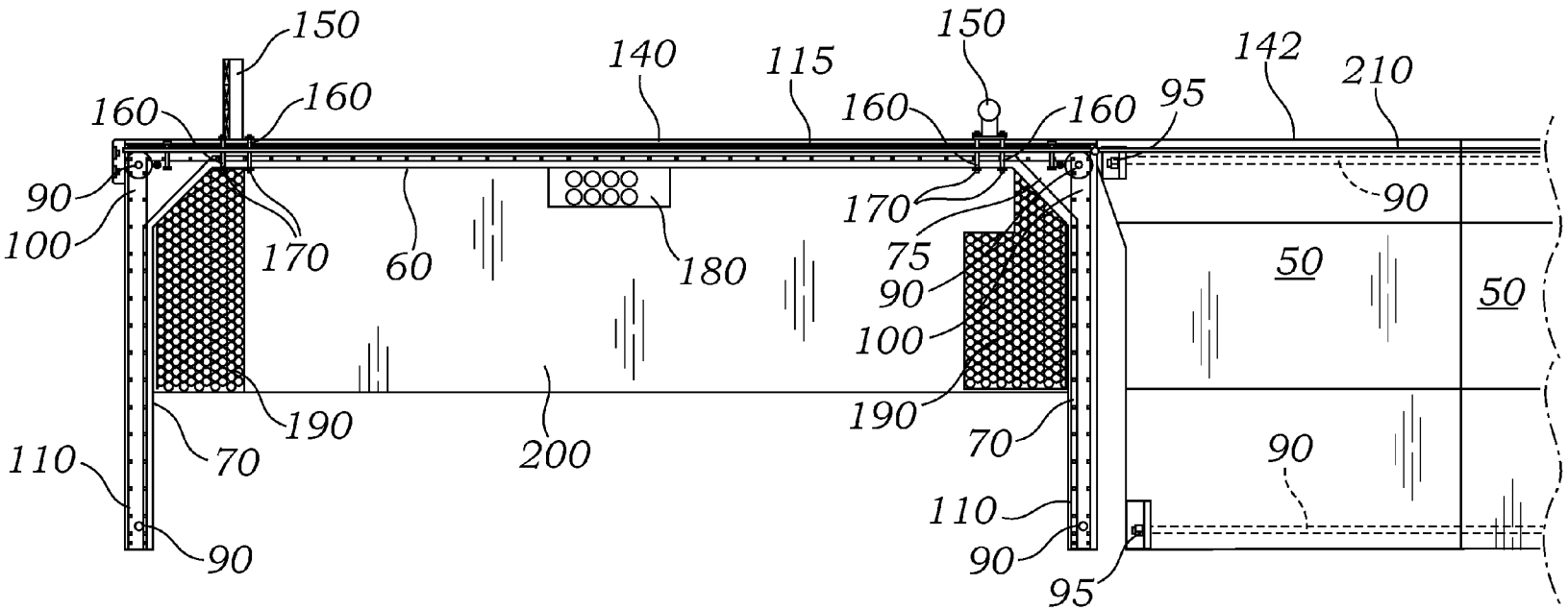
FIG. 5 is a partial, enlarged view of the assembly of FIG. 4.

A plurality of concrete sections 50 can be coupled together to form a single monolithic structure, or an assembly, 140, 142. For example, as shown in FIGS. 4 and 5, a float assembly 142 can comprise a plurality of sections 50 that are placed and/or coupled end-to-end such that the side of one section abuts the end of another section. Float assembly 142 can be unitized or coupled together to form a single monolithic structure in a variety of ways using various connecting members.

For example, as shown in FIGS. 4 and 5, assembly 142 can be coupled or unitized by passing rods 90, such as those available from Dywidag-Systems International, through two or more openings or holes in the concrete sections. Rods 90 can be secured at the ends of the assembly 142. In particular, rods 90 can be passed through the longitudinal length of the side walls 70, as shown in FIG. 5. To accommodate rods 90, holes can be pre-formed in the concrete sections 50 along the longitudinal length of the deck portion 60 or side walls 70 at the desired locations.

Figure 6:
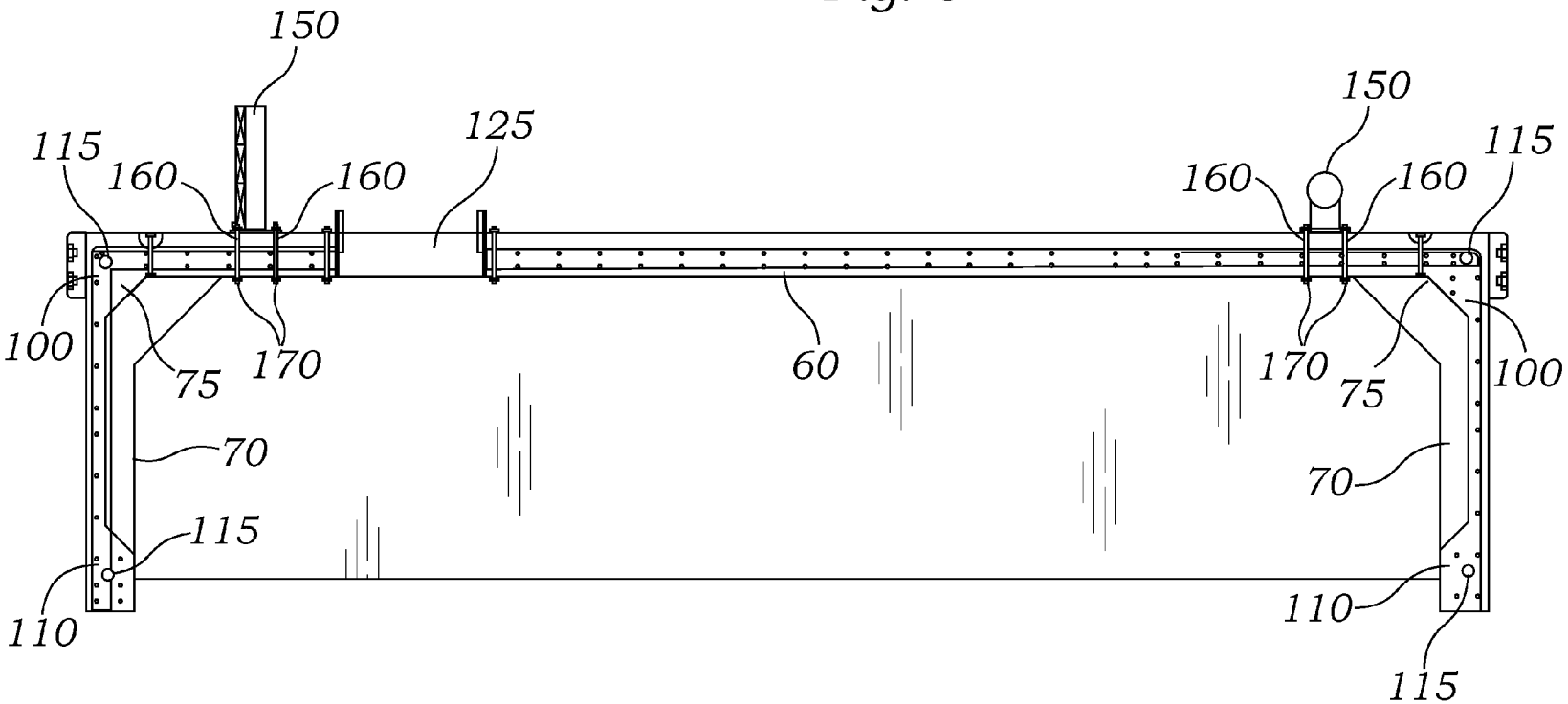
FIG. 6 is a cross-sectional view of another embodiment of a concrete section.

The holes through which rods 90 pass are desirably defined by corrugated steel conduits that are positioned between the outer element 20 and inner element 30 before the concrete is poured into the form 10 and/or cured. As best shown in FIG. 6, for example, corrugated steel conduits 115 can be positioned at an upper portion 100 and a lower portion 110 of a side wall 70. FIG. 6 shows a concrete section 50 having a deck portion 60 and side walls 70 that are formed approximately 6 feet high by 24 feet wide. As shown in FIG. 6, steel conduits 115 extend through the length of the concrete sections 50 at four different locations. If desired, openings 125 can be formed in the deck portion 60 to allow for vertical structural supports (or piles) to pass through the deck portion 60. FIG. 6 illustrates a concrete float dock section formed by placing an inner liner (not shown) against the inner element 30 (form), which enables casting of thinner wall sections. The forming of thinner wall sections can facilitate the creation of a dock section that has a lower weight float and, therefore, a lower draft. The inner liner can be, for example, an inner steel form.

The steel conduits desirably have an inner diameter that is larger than the diameter of the rods 90 so that the rods can be easily positioned with the steel conduits. The steel conduits 115 are desirably positioned at the same location in each concrete section 50, so that when a plurality of concrete sections 50 are lined up end-to-end (as shown in FIG. 3), a single rod 90 can be passed through the corresponding steel conduits 115 of a plurality of concrete sections 50.

After the rods 90 are passed through the steel conduits, the rods can be tensioned and secured using nuts 95 (as shown in FIG. 5). Desirably, a single rod 90 passes through a plurality of concrete sections 50 and is secured at the opposite ends of the assembly formed by the plurality of concrete sections. For example, as shown in FIG. 4, six concrete sections 50 can be joined together by four rods 90, with the rods 90 being secured (nutted) at the first end 120 and the second end 130 of the unitized concrete float assembly 142.

Although six concrete sections are shown end-to-end in FIG. 4, the number of concrete sections, as well as the length and width of each individual section, can vary. Similarly, although four rods 90 are shown passing through each side wall 70 of the concrete sections 50 in FIG. 4, more or fewer rods 90 can be used. In addition, rods 90 can be positioned at other locations in the concrete section 50, including in the deck portion 60, corner portions 75, and at positions in the side walls 70 other than those illustrated in the figures. After the rods are tensioned and secured at both ends of the unitized structure containing the plurality of concrete sections 50, the steel conduits 115 are desirably grout-filled to provide a continuously tensioned float unit. The overall length of the combined, unitized structure of concrete sections 50 can vary, but is typically between about 20 feet and 100 feet in length.

Figure 14:
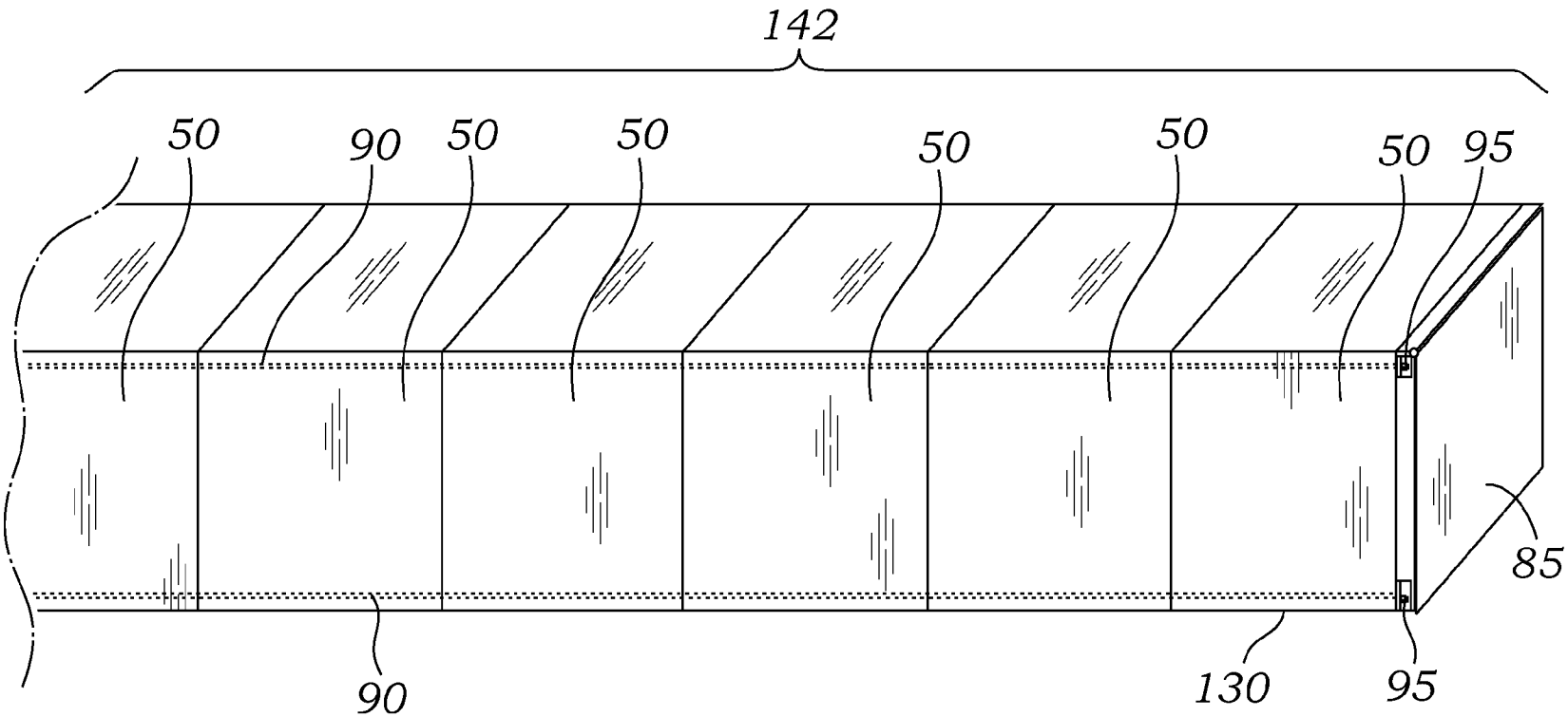
FIG. 14 is an elevation view of a concrete float assembly having at a plurality of concrete sections coupled together, according to one embodiment, with an end panel.

If desired, an end panel 85 can be positioned and secured to the one or both ends of a float assembly. FIG. 14 illustrates an end panel 85 positioned at end of float assembly 142. End panel 85 can be a solid concrete structure that is substantially rectangular in shape to correspond to the open front and/or back portion of a concrete section 50. As shown in FIG. 14, if an end panel is positioned at an end of a float assembly, one or more rods 90 can extend past the float section 50 at that end of float assembly 142, and terminate with or outside the end panel 85. In this manner, rods 90 and nuts 95 can be used to secure the end panels 85 to the opposite ends of the float assembly. Accordingly, the end panels can form the fourth and/or fifth sides of the unitized (or monolithic) concrete float.

Because the concrete sections are not created with a positive displacement element within the concrete, appurtenances 150, such as mooring rails and cleats, utilities, and the like, can be added to the concrete sections 50 more easily as compared to conventional concrete float sections. When the concrete is cast in the manner described above (i.e., without an EPS foam as an internal structure), it is possible to access any location on the lower surface of the deck portion 60 or any location on the inner surfaces of the side walls after the concrete is cured. Thus, appurtenances 150 can be coupled to the concrete sections 50 by creating holes in the structure which entirely penetrate the deck portion 60 and bolting the appurtenance to the upper surface of the deck portion 60 (e.g., the concrete deck) or the lower surface of deck portion 60 or to side walls 70. For example, as shown in FIG. 5, appurtenances 150 can be secured to the deck portion 60 using bolts 160 and nuts 170.

Bolting provides a very secure connection between the concrete section 50 and the appurtenance. In contrast, when concrete floats are formed with a positive displacement element integral to the concrete float, it is not possible to access the lower surface portions of the deck section directly above the displacement element and instead of bolting appurtenances to the structure, they must be affixed to inserts that are partially drilled and/or placed into the deck at the time of casting.

In addition, because the structure is created without EPS foam integral formed beneath the deck portion 60, it is possible to add any necessary electrical or mechanical features to the concrete section 50 after curing. For example, as shown in FIGS. 4 and 5, a conduit 180 for utility cables (e.g., electrical lines, telephone lines, and water supply lines) and the like can be added to the concrete section 50 after the concrete section 50 has been fully cured. Alternatively, longitudinal conduits (or chases) can be provided in the structure of EPS foam that can be added to the concrete section 50 beneath the dock portion 60 (as discussed in more detail below).

Referring again to FIGS. 4 and 5, upon completion of the casting, EPS foam (or other similar buoyancy providing element) 190 may be added by inserting it within the cavity of the concrete section(s) formed by the steel form. Preferably, although not necessarily, the float assembly 140, 142 is unitized before the foam 190 is positioned and coupled to the float assembly 140, 142. By unitizing the float assembly before installing the foam 190, the foam 190 can be delivered in large blocks and cut to fit the unitized assembly at the assembly location, minimizing freight costs and other associated delivery expenses. If the foam 190 is delivered in large blocks (e.g., 24' long by 8' wide), the number of foam sections needed to fill a unitized float assembly can be minimized. If multiple blocks are required because of the size of the float assembly 140, 142, or because of the overall foam core 190, two or more cut foam members or docks can be glued together to form a single foam member 190 that can be received within the float assembly 140, 142. Accordingly, depending on the particular installation, the float assembly can include a single buoyancy core that extends the entire length of the float assembly or multiple buoyancy core elements, each of which can be sized to extend through the cavity of one concrete section or multiple concrete sections of the float assembly.

In alternative embodiments, a respective buoyancy core element can be positioned and secured in place within each float section 50 before the float sections are connected to each other and unitized.

The added EPS foam can generally be maintained (secured) within the float assemblies 140, 142 due to the contact between the foam 190 and the float assemblies 140, 142 resulting from the weight of the float assemblies 140, 142 and the buoyancy of the foam 190 and/or a frictional fit between the foam and the inner surfaces of the surrounding concrete sections. The attachment of the EPS foam to the concrete sections 50 of the float assembly can also be accomplished by any known attachment method, e.g., by using a suitable adhesive or by using one or more mechanical fasteners. For example, a mechanical fastener can comprise a plurality of pin members that pass through openings in the sides of the concrete sections 50 and engage with the foam 190.

The EPS foam can also receive a protective coating of polyurethane or another suitable material. This protective coating is desirably a thin layer of polyurethane that protects the EPS foam from degrading as it is exposed to the elements. For clarity, FIGS. 4 and 5 show the EPS foam partially cut away from the central portion below deck portion 60. However, the EPS foam desirably is dimensioned such that it extends between the opposing side walls 70, including central area 200. The depth (height) of the EPS foam core can be varied depending on the application and the desired amount of buoyancy of the concrete float.

By increasing or decreasing the depth of the added EPS foam, freeboard can be increased or decreased respectively. Freeboard is the distance from the waterline to the top of the deck portion 60. Because the EPS foam is added to each concrete section 50 after construction and curing of the individual concrete sections 50, it is possible to adjust the freeboard "on-the-fly" (at the job site). Thus, the amount of EPS foam used in each application (and, therefore, the amount of freeboard) can be determined and/or varied after the concrete sections have been formed. If desired, the EPS foam can extend beyond the depth of the side walls 70, so that a portion of the EPS foam extends beneath the lowest surface of the concrete section 50. Alternatively, the EPS foam can be selected so that it does not extend beyond the depth of the side walls 70.

A plurality of unitized float assemblies can be connected to each other to form a larger floating dock structure. For example, a first float assembly 140 can be positioned adjacent and connected to a second float assembly 142. Float assembly 140 can comprise a plurality of concrete sections 50 that are placed and/or coupled end-to-end in the same manner as float assembly 142, as discussed above. Float assemblies 140, 142 can be positioned at a ninety degree angle from each other, as shown in FIGS. 4 and 5.

Float assemblies 140, 142 can be coupled together using any known techniques or mechanisms. For example, two completed, post-tensioned float assemblies can be placed end-to-end and tensioned together (on land or in the water) into lengths exceeding 100' by passing pre-greased, sheathed tension cables through one or more additional longitudinal chase tubes (or steel conduits 115) cast into the floats. Alternatively, two float assemblies can be positioned at a 90 degree angle from one another and coupled together in a perpendicular relationship. As shown in FIG. 5, for example, a continuous wire rope 210 can be passed through a tube or conduit 115 preformed in the deck portion 60 of a concrete section of float assembly 140 and through a corresponding conduit 115 in respective deck portions 60 of one or more concrete sections 50 of float assembly 142. Because of the different orientations of float assemblies 140, 142, the relative positions of the conduits 115 in each float assembly would have to be different, as shown in FIG. 5. With regard to float assembly 142, conduits 115 extend longitudinally along deck portions 60, desirably at a position near the side walls 70. With regard to float assembly 140, however, in order to receive rope 210 and secure float assembly 140, 142 to one another, conduit 115 extends transversely along the deck portion 60 of float assembly 140.

One or more wire ropes 210 can be used and can extend through any number of chase tubes or conduits to connect any number of concrete sections or unitized concrete sections (e.g., to couple multiple float assemblies). For example, wire ropes 210 can be used to further secure concrete sections that have been unitized using rods 90 and placed end-to-end in the same direction. Alternatively, wire rope 210 can be used, as discussed above, to couple two float assemblies that are oriented at different angles (such as 90 degrees) from each other or placed end-to-end relative to each other. Wire rope 210 can be secured by any suitable technique or mechanism at one or more ends of the float assemblies 140, 142 to couple them together.

Figure 7:
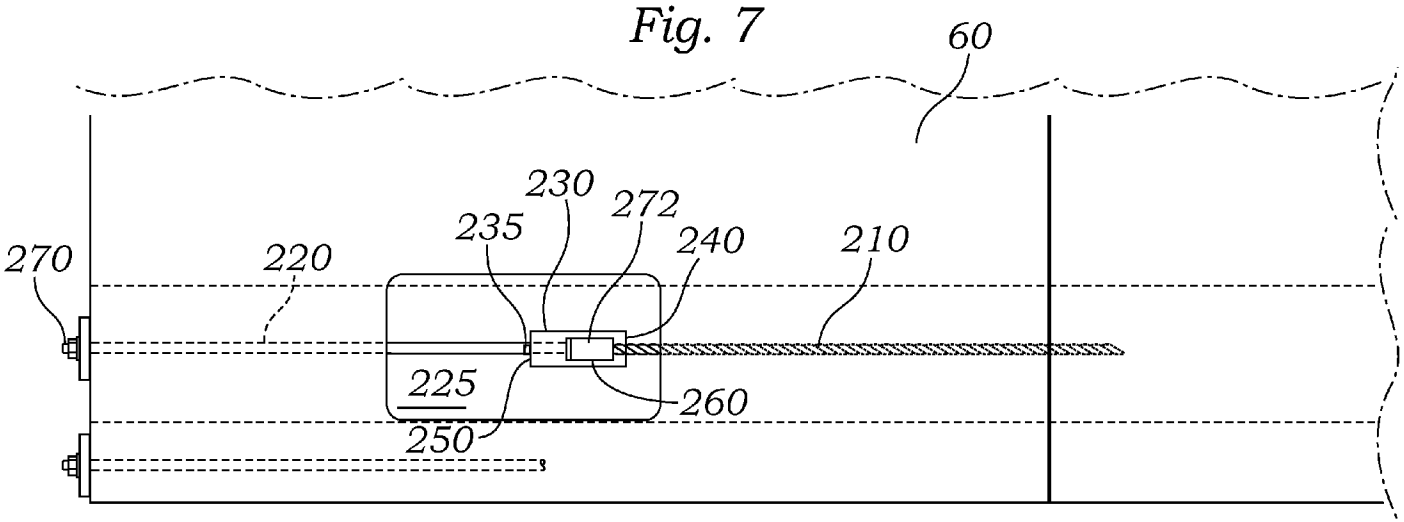
FIG. 7 is a top view of an embodiment of a connecting device for connecting a rod to a wire rope used for interconnecting adjacent float sections.
Figure 8:
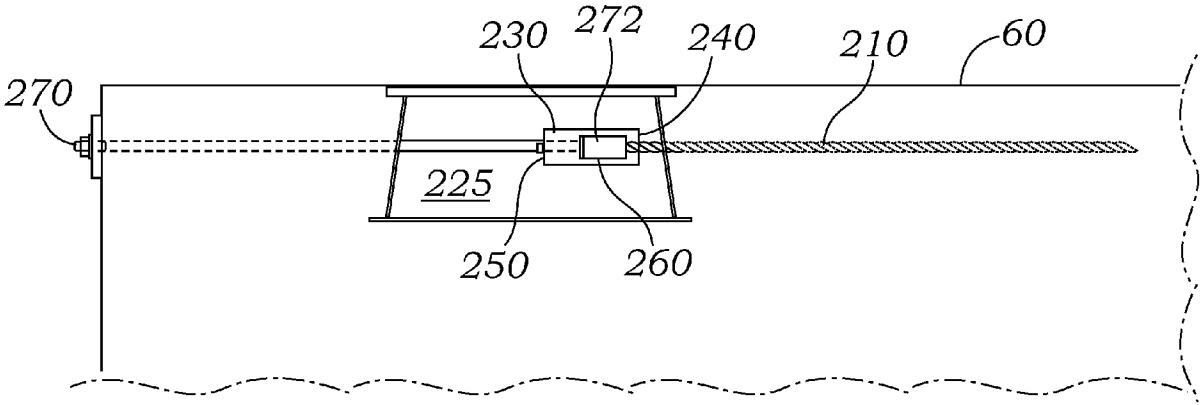
FIG. 8 is a side view of an embodiment of a connecting device for connecting a rod to a wire rope used for interconnecting adjacent float sections.

For example, FIGS. 7 and 8 illustrate one such technique for securing the end of a wire rope 210 to a concrete section 50. FIG. 7 illustrates a top view of a deck portion 60 and FIG. 8 illustrates a side view of the same deck portion 60. An opening 225 is formed in the deck portion 60 so that it is possible to access a connection device for connecting a wire rope 210 to a rod 220. The connection device comprises a round bar, or coupler, 230 that has with opposite ends 250 and 240. At a first end 250, the round bar 230 is internally threaded to receive an externally threaded portion 235 of rod 220. The other end of rod 220 can be secured at a vertical portion (side) of the deck portion 60 by a nut 270, as shown in FIGS. 7 and 8. The vertical portion can be accessible through an opening in a top portion of the deck 60 or through an opening in a side portion of the deck 60.

Figure 11:
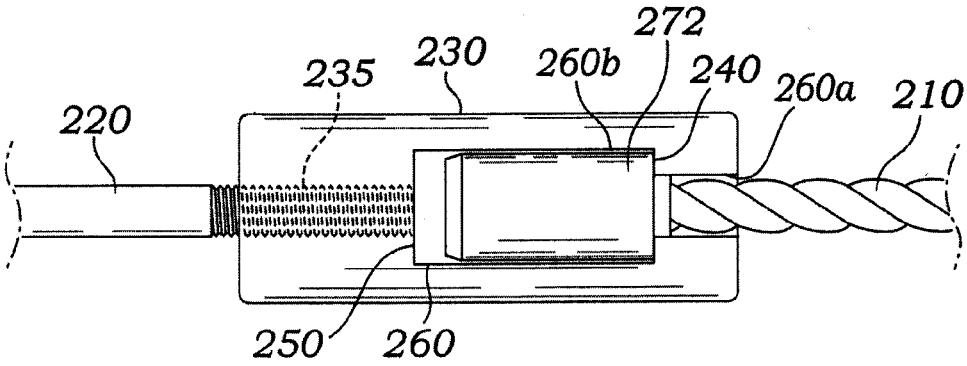
FIG. 11 is a view of a connection device for connecting a wire rope to a rod.
Figure 12:
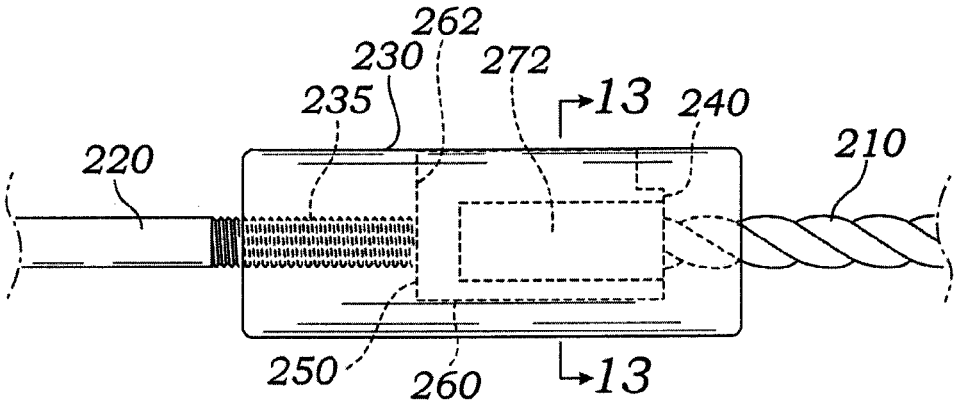
FIG. 12 is a side view of the connection device of FIG. 11.
Figure 13:
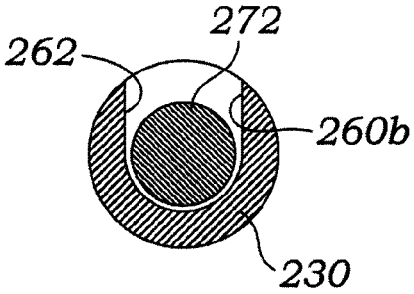
FIG. 13 is a section view taken along line 13-13 of FIG. 12.

As best shown in FIGS. 11-13, the coupler 230 is also formed with a stepped bore comprising a first bore section 260*a* opening at the second end 250 and a second, larger diameter bore section 260*b*. The wire rope 210 passes through the first bore section 260*a* and an enlarged portion 272 of the rope is captured within the second bore section 260*b*. The enlarged end portion 272 has a larger diameter than the wire rope 210, and can be an integral structure of the wire rope 210 or it can comprise a separate element that is secured to the end portion of the wire rope 210. The enlarged end portion 272 of the wire rope 210 can be positioned in the bore section 260*b* by inserting the end portion 272 through a side opening 262 in the coupler 230. A similar connection device can be used to secure the opposite end of the rope 210 to another concrete section. The rope can be tensioned by tightening the nut 270 and/or the coupler 230 relative to rod section 235 at one or both ends of the rope.

Figure 9:
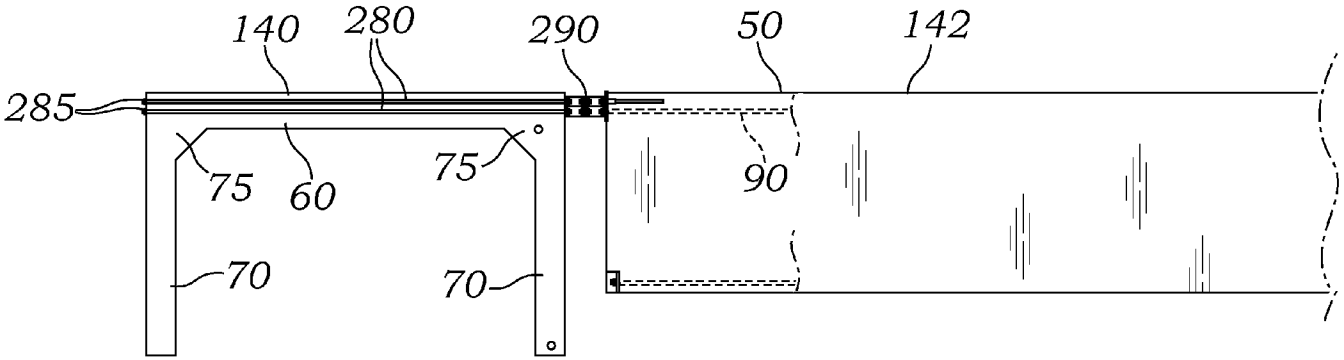
FIG. 9 is a side view of an embodiment of a hinge member for connecting a first concrete section to a second concrete section.
Figure 10:
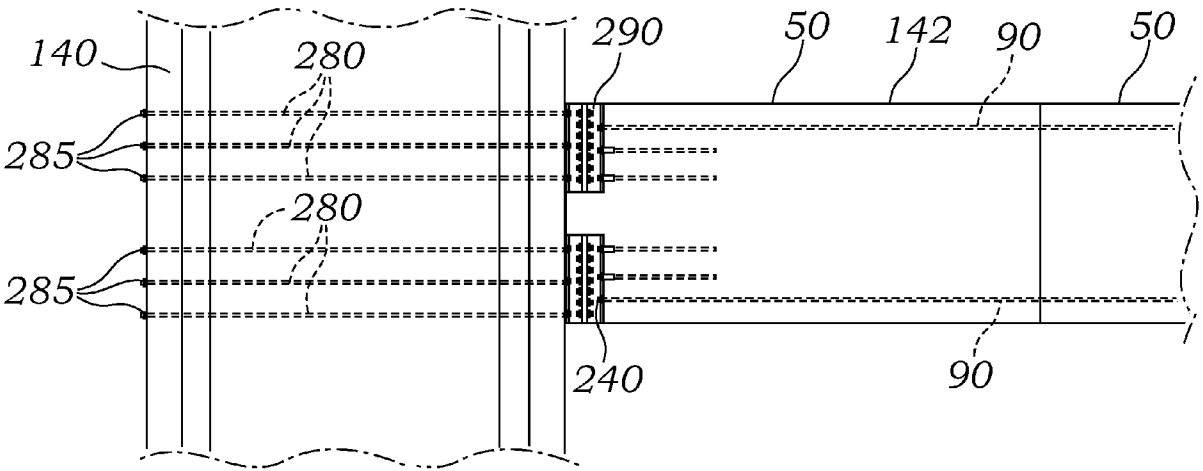
FIG. 10 is a top view of the embodiment shown in FIG. 9.

FIGS. 9 and 10 show another embodiment for connecting concrete sections that are positioned at different orientations. As shown in FIGS. 9 and 10, a plurality of concrete sections 50 are unitized (coupled together) to form a float assembly 142 and then coupled to a second float assembly 140 that is oriented perpendicular to the float assembly 142. FIG. 9 shows a side view of the float assembly 140 connected to the float assembly 142 at a ninety degree angle, and FIG. 10 shows a top view of the same. As discussed in more detail above and shown in FIGS. 9 and 10, rods 90 extend through the plurality of concrete sections 50 of each float assembly 140, 142 and are tensioned and secured so that the plurality of concrete sections 50 in each assembly are effectively unitized.

Additional rods 280 can be used to secure one of the concrete sections of float assembly 140 to an adjacent concrete section 50 of float assembly 142. Rods 280 are secured at one end to the concrete section of float assembly 140 using respective nuts 285. At their other ends, rods 280 can be secured to a flexible hinge member 290. The hinge member 290 is also secured to the adjacent concrete section 50 of float assembly 142 by rods 90. As shown, more than one hinge member 290 can be used to interconnect adjacent float assemblies. Any of various hinge members or other known connectors can be used to connect adjacent float assemblies, such as those described in U.S. Pat. Nos. 5,529,012; 6,450,737; and 7,390,141, each of which is hereby incorporated by reference in its entirety.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A method of assembling a concrete floating dock, comprising:

positioning a plurality of concrete sections adjacent to one another, each concrete section comprising a deck portion, a pair of longitudinally extending side walls, and two opposing open faces between respective ends of the side walls, the concrete sections being positioned so that the open face of one concrete section abuts the open face of an adjacent concrete section;

coupling the plurality of concrete sections together to form a unitized float assembly; and positioning at least one buoyant member beneath the deck portion and between the pair of side walls of one or more of the concrete sections after positioning the plurality of concrete sections adjacent to one another.

2. The method of claim 1, further comprising:

forming the at least one buoyant member by cutting a portion from a block of buoyant material, the at least one buoyant member being cut to fit between the pair of side walls of one or more concrete sections, and positioning the at least one buoyant member beneath the deck portion and the side walls of one or more of the concrete sections after the concrete sections are coupled to each other.

3. The method of claim 1, wherein the act of positioning the at least one buoyant member comprises positioning the at least one buoyant member beneath the deck portion and pair of side walls of two or more of the concrete sections.

4. The method of claim 3, wherein the at least one buoyant member comprises a single buoyant member that extends between the pairs of the longitudinally extending side walls of each concrete section.

5. The method of claim 1, wherein the buoyant member comprises a plurality of buoyant members coupled together end-to-end by an adhesive.

6. The method of claim 1, further comprising securing the at least one buoyant member to one or more of the longitudinal side walls.

7. The method of claim 6, wherein the act of securing the buoyant member comprises securing inserting mechanical fasteners through one or more openings in one or more of the side walls of the concrete sections and into the buoyant member.

8. The method of claim 1, wherein the act of coupling the plurality of concrete sections to form the first unitized assembly comprises passing rods through openings that extend longitudinally through the side walls of the concrete sections and securing the rods to a first end of the first unitized assembly and to a second end of the first unitized assembly.

9. The method of claim 1, further comprising:

securing a first end panel against an open face of one of the concrete sections, the end panel forming a first end of the unitized assembly.

10. The method of claim 9, further comprising:

securing a second end panel against an open face of another of the concrete sections, the second end panel forming a second end of the unitized assembly.

11. The method of claim 1, further comprising:

coupling a second plurality of concrete sections to one another to form another unitized float assembly, each concrete section comprising a deck portion and a pair of longitudinally extending side walls;

positioning at least one buoyant member beneath the deck portion and between the pairs of the longitudinally extending side walls of the one or more of the concrete sections of the another unitized float assembly; and coupling the unitized float assembly to the another unitized float assembly.

12. The method of claim 11, wherein the unitized float assembly is oriented substantially perpendicular to the another unitized float assembly.

13. The method of claim 12, wherein the coupling of the unitized float assembly to the another unitized float assembly comprises securing a first portion of a hinge member to the unitized float assembly and securing a second end of the hinge member to the another unitized float assembly.

* * * * *